US007216390B2

(12) United States Patent
Vaskuthy

(10) Patent No.: US 7,216,390 B2
(45) Date of Patent: May 15, 2007

(54) CORNER GUARD FOR BOX SPRING

(76) Inventor: Istvan Vaskuthy, 1055, Bourget, St-Hyacinthe, Quebec (CA) J2S 6P7

( * ) Notice: Subject to any disclaimer, the term of this patent is extended or adjusted under 35 U.S.C. 154(b) by 70 days.

(21) Appl. No.: 11/182,090

(22) Filed: Jul. 15, 2005

(65) Prior Publication Data

US 2007/0011818 A1 Jan. 18, 2007

(51) Int. Cl.
*A47C 17/00* (2006.01)

(52) U.S. Cl. ..... 5/739; 5/717

(58) Field of Classification Search ..... 5/717, 5/739

See application file for complete search history.

(56) References Cited

U.S. PATENT DOCUMENTS 5,265,291 A * 11/1993 Callaway ..... 5/254
5,884,385 A * 3/1999 Quintile ..... 29/513
6,687,929 B2 * 2/2004 DeFranks et al. ..... 5/254
2006/0225222 A1 * 10/2006 Vaskuthy ..... 5/739

* cited by examiner

*Primary Examiner*—Patricia Engle
*Assistant Examiner*—Jonathan Liu
(74) *Attorney, Agent, or Firm*—Eric Fincham

(57) ABSTRACT

A corner guard arrangement for a box spring, the corner guard arrangement having first and second members formed of a sheet material and being interlocked together, the interlocking arrangement being such that the first and second members are in sliding engagement to permit adjustment for different height box springs, one end of each of the first and second members being engaged with a perimeter wire on the box spring. The arrangement permits a smooth covering of fabric material on the box spring.

3 Claims, 4 Drawing Sheets

CORNER GUARD FOR BOX SPRING

FIELD OF THE INVENTION

The present invention relates to box springs for bedding, and more particularly, relates to a corner member suitable for use on box springs.

BACKGROUND OF THE INVENTION

Mattresses and box springs have been known in the art for many years. Typically, the arrangement is such that the mattress is utilized to directly support one or more people, with a box spring being in position underneath the mattress and above a supporting frame or the like. The box spring provides additional cushioning and supports the mattress and will typically include a variety of springs within its interior.

In the manufacture of box springs, the outside is covered with a fabric material. Along the sides and ends of the box spring, the fabric material may easily be stretched and held in place without problem. However, on the corners, there is a tendency for the fabric to give either inwardly or outwardly when the box spring is in use. In order to overcome this, many manufacturers provide a stuffing of a material such as scrap fiber material at the corners.

A further problem at the corner of box springs and the like is that different sizes are utilized and thus a single piece of material is not suitable.

SUMMARY OF THE INVENTION

It is an object of the present invention to provide a corner guard for box springs or the like and which corner guard is adjustable for different sizes.

According to one embodiment of the present invention, there is provided, a corner guard arrangement for a box spring, the corner guard arrangement comprising a first member formed of a sheet material, a first end of the first member having attachment means for securing the member to a wire of the box spring, a second member formed of a sheet material, and first end of the second member having second attachment means for securing the member to a wire of the box spring, the first and second members each having interlocking means, the interlocking means being arranged to maintain the first and second members together when in an assembled condition while permitting sliding movement of the first and second members with respect to each other, the arrangement being such that when the first and second members are assembled, the first end of the first member and the second end of the second member can be secured to top and bottom wires respectively of the box spring.

According to a further aspect of the present invention, in a box spring having a plurality of wires forming a plurality of coils, with an outer perimeter wire extending about the top and bottom thereof, the improvement comprising a corner guard, the corner guard comprising a first member formed of a sheet material, a first end of the first member being secured to an upper perimeter wire of the box spring, a second member formed of sheet material, a second end of the second member being secured to a lower perimeter wire of said box spring, the first and second members being interlocked together, the interlocking means permitting sliding movement of the first and second members with respect to each other.

The corner guard arrangement, as set forth above, comprises first and second members which are formed of a sheet material and preferably of a plastic sheet material, many of which are well known to those skilled in the art. Each of the members is preferably formed to have a body portion which is arcuate in configuration, but has a greater radius than the radius of a box spring corner. In so doing, the member will exert a slight outward force when it is placed in position on the box spring corner.

The two members are interlocked in a relationship which permits sliding movement therebetween. Accordingly, the device can be adjusted for different sizes of box springs.

BRIEF DESCRIPTION OF THE DRAWINGS

Having thus generally described the invention, reference will be made to the accompanying drawings illustrating an embodiment thereof, in which.

DESCRIPTION OF THE PREFERRED EMBODIMENTS

Figure 1:
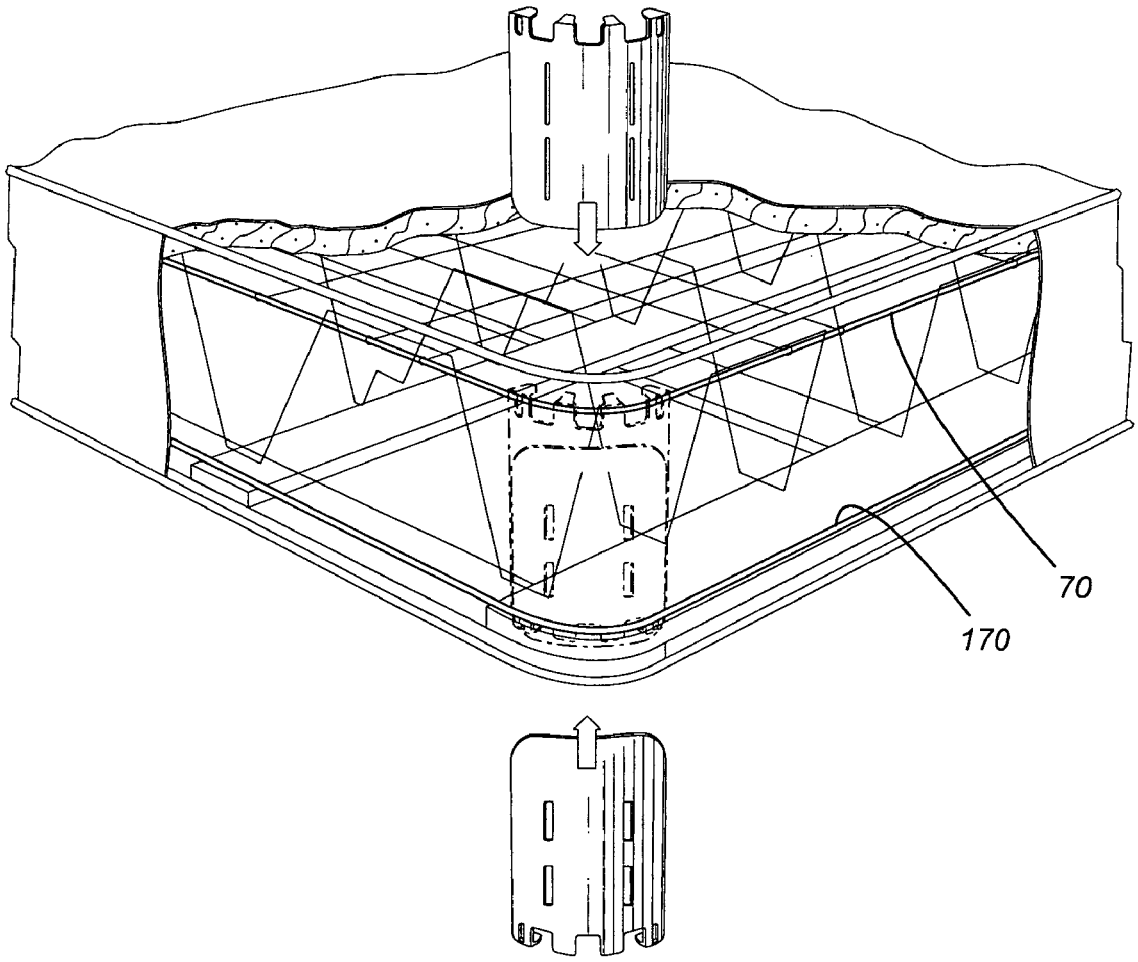
FIG. 1 is a perspective view, partially in cut-away, of a corner portion of a box spring.
Figure 2:
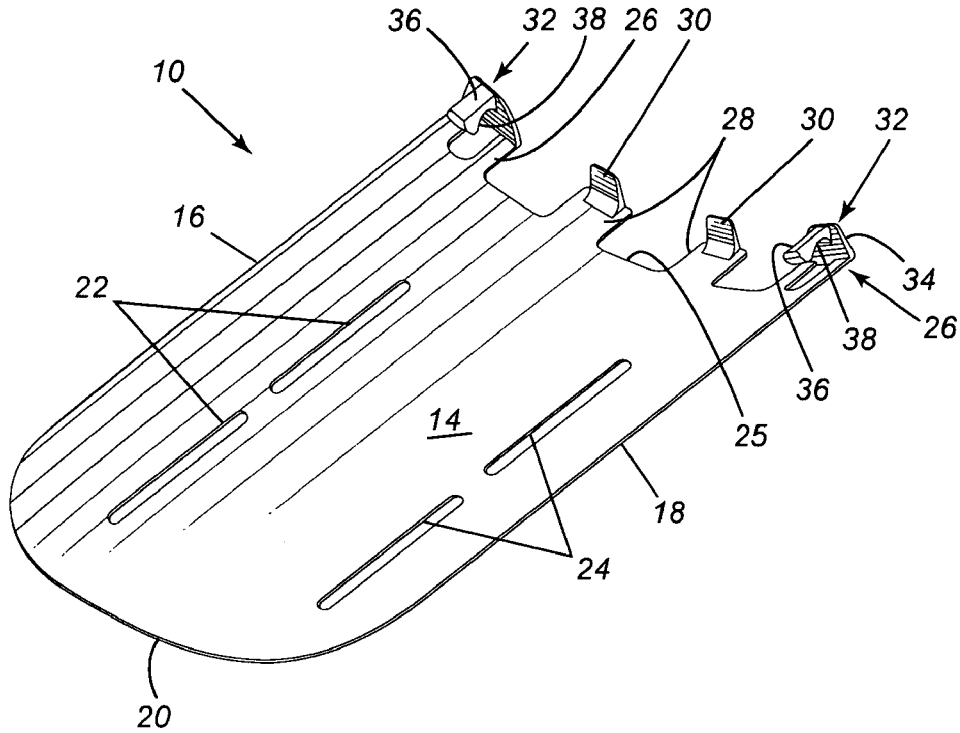
FIG. 2 is a perspective view of a first member of a corner guard according to the present invention.
Figure 3:
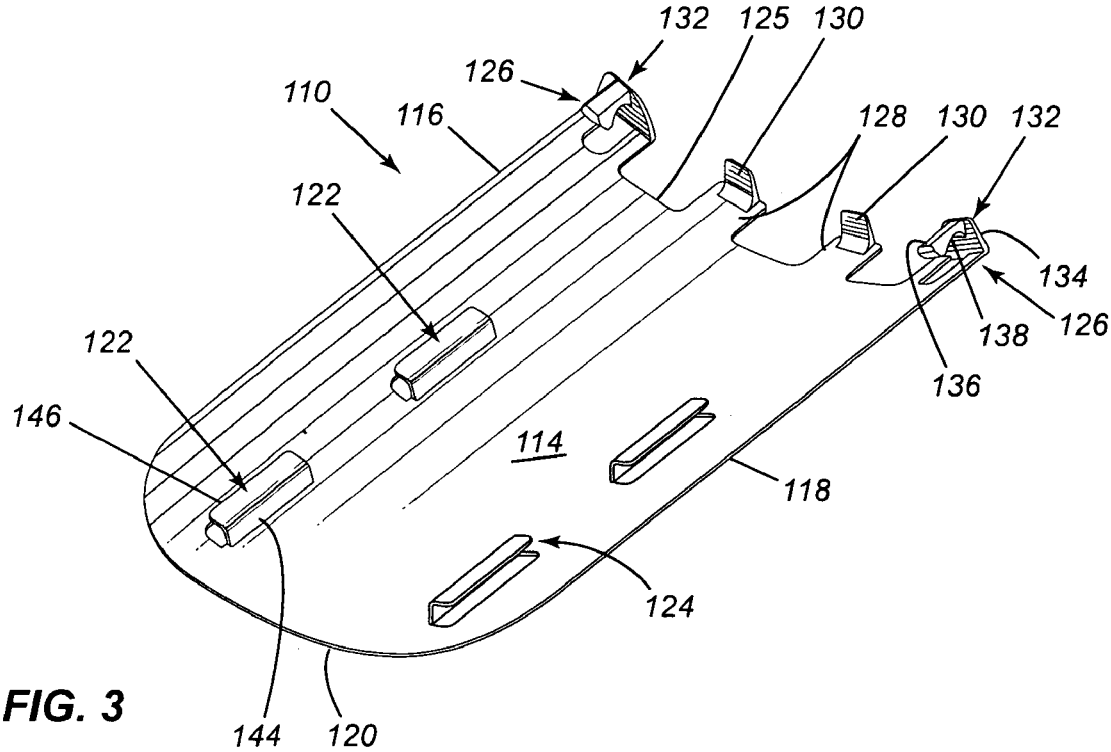
FIG. 3 is a perspective view of the second member.

Referring to the drawings in greater detail, the corner guard of the present invention comprises first and second members generally designated by reference numerals 10 and 110 respectively.

First member 10 has a main body portion 14 which is defined by a pair of side edges 16, 18 and a bottom edge 20. Formed within main body portion 14 are two sets of vertically aligned slots 22, 24. At an upper marginal edge 25, main body portion 14 has a pair of outer legs 26 and a pair of inner legs 28. Inner legs 28 each have of a flange 30 extending outwardly while outer legs 26 each comprise a retaining member 32.

Each retaining member 32 comprises an outwardly extending portion 34 and a downwardly extending portion 36 which together with the main body of first member 10 defines a U-shaped configuration. Downwardly extending portion 36 includes a concave recess 38.

Second member 110 also has a main body portion 114. Main body portion 114 is defined by side edges 116, 118 along with a bottom edge 120. Extending outwardly from main body portion 114 are two sets of vertically aligned projections 122, 124. Each of the projections 122, 124 comprise a first perpendicular portion 144, and a second portion 146 which together give each of projections 122, 124 a generally L-shaped configuration.

At a lower marginal edge 125, main body portion 114 has a pair of outer legs 126 and a pair of inner legs 128. Inner legs 128 each have a flange 130 extending outwardly while outer legs 126 each comprise a retaining member 132. Each retaining member 132 has an outwardly extending portion 134 and a downwardly extending portion 136 which, together with main body portion 114, define a U-shaped recess. A concave recess 138 is formed in downwardly extending portion 136.

Figure 4:
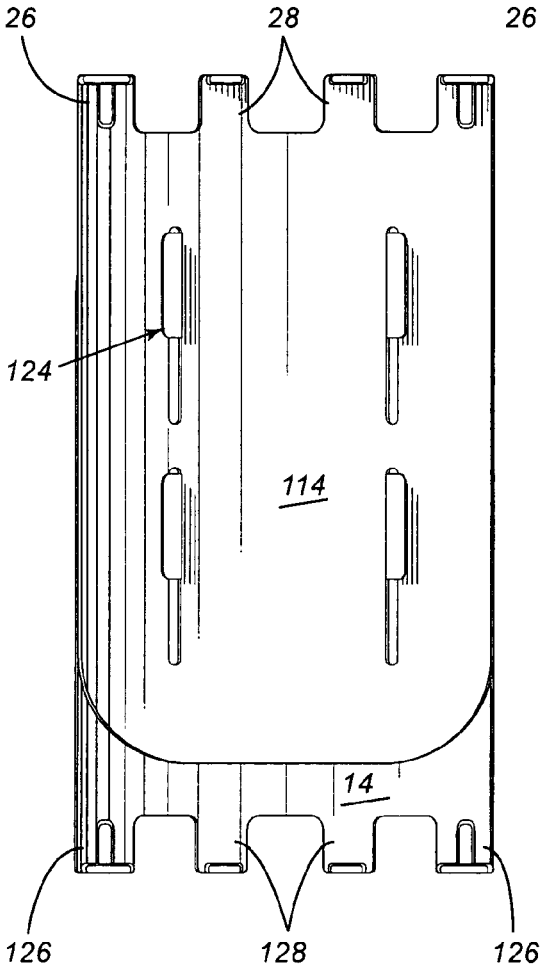
FIG. 4 is a front elevational view of the corner guard of the present invention in a retracted position.
Figure 5:
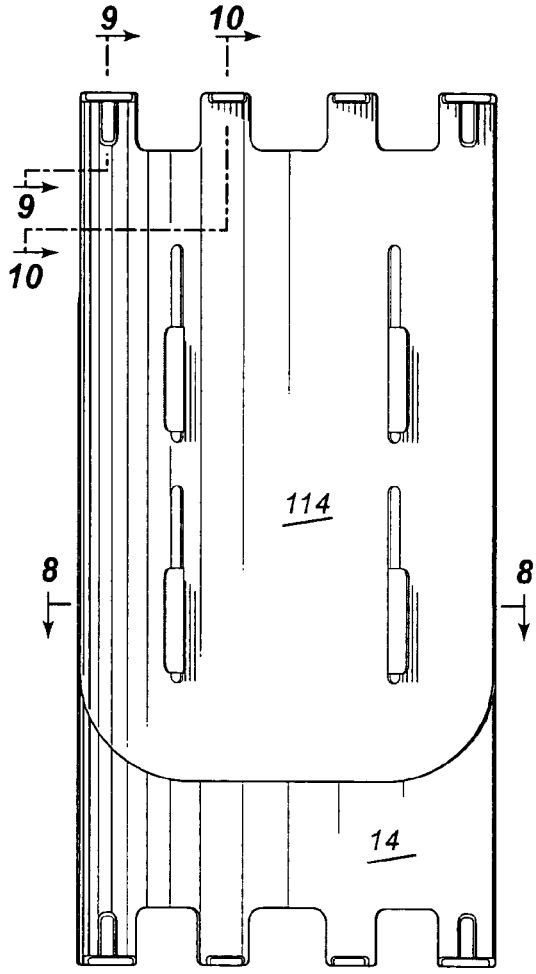
FIG. 5 is a front elevational view thereof in an extended position.
Figure 6:
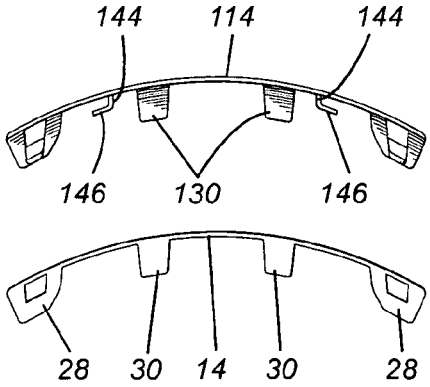
FIG. 6 is a top plan view of the first and second members.
Figure 7:
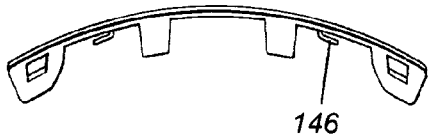
FIG. 7 is a bottom plan view thereof.
Figure 8:
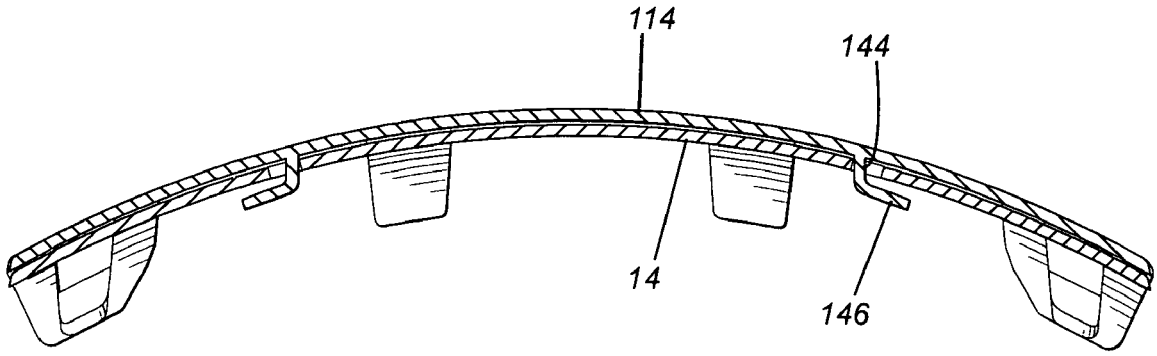
FIG. 8 is a cross sectional view taken along the lines 8—8 of FIG. 5.
Figure 9:
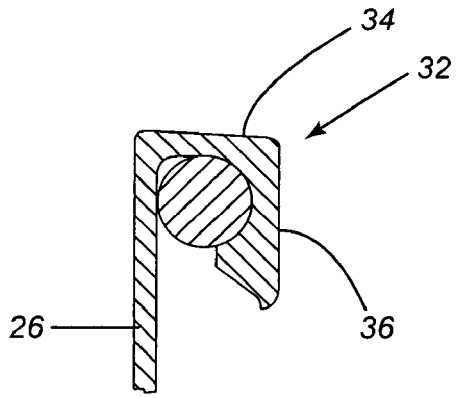
FIG. 9 is a cross sectional view taken along the lines 9—9 of FIG. 5.
Figure 10:
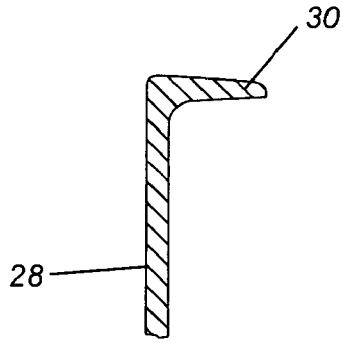
FIG. 10 is a cross sectional view taken along the lines 10—10 of FIG. 5.

In use, the two members are assembled together as shown in FIGS. 4 and 5 with the upper retaining members 32 being hooked on and retained by an upper perimeter wire 70 while retainer members 132 are hooked on lower perimeter wire 170.

It will be understood that the above described embodiment is for purposes of illustration only and that changes and modifications may be made thereto without departing from spirit and scope of the invention.

I claim:

1. In a box spring having a plurality of wires forming a plurality of coils, with outer perimeter wires extending about the top and bottom thereof, the improvement comprising a corner guard, said corner guard comprising:

a first member formed of a sheet material, a first end of said first member being secured to an upper perimeter wire of said box spring;

a second member formed of sheet material, a second end of said second member being secured to a lower perimeter wire of said box spring;

said first and second members being interlocked together, in a manner permitting sliding movement of said first and second members with respect to each other.

2. The improvement of claim 1 wherein each of said first and second members are formed of a flexible plastic material.

3. The improvement of claim 2 wherein said first and second members are interlocked together by means of a plurality of slots formed in one of said members and a plurality of projections formed in a second one of said members, said projections extending through said slots.

* * * * *